United States Patent [19]

Baron et al.

[11] 4,293,133

[45] Oct. 6, 1981

[54] GAME DEVICE

[76] Inventors: Martin Baron, 7804 Skander Dr., Box 28222, Sacramento, Calif. 95828; Ronald J. Retterer, 9030 Leatham Ave., Fair Oaks, Calif. 95628

[21] Appl. No.: 165,984

[22] Filed: Jul. 7, 1980

[51] Int. Cl.[3] ..... F41J 1/00

[52] U.S. Cl. ..... 273/345; 273/109; 46/236; 46/240

[58] Field of Search ..... 273/345, 1 GB, 1 GD, 273/1 M, 239, 109–117; 46/236, 240

[56] References Cited

U.S. PATENT DOCUMENTS

| | | | |
|---|---|---|---|
| 2,295,452 | 9/1942 | Deaton | 273/239 |
| 2,511,774 | 6/1950 | Goldsmith | 273/1 M X |
| 2,562,089 | 7/1951 | Fishlove | 273/345 |
| 2,995,372 | 8/1961 | Hines | 46/240 X |
| 3,223,419 | 12/1965 | Isaacs et al. | 273/239 X |
| 3,477,531 | 7/1949 | Volman | 273/345 |
| 3,764,145 | 10/1973 | Schrafft | 46/240 X |
| 3,843,125 | 10/1974 | Loose et al. | 273/1 GD X |
| 4,013,291 | 3/1977 | Brass et al. | 273/239 |
| 4,124,951 | 11/1978 | Wallch | 46/240 X |
| 4,172,597 | 10/1979 | Smith et al. | 273/239 |

*Primary Examiner*—Paul E. Shapiro
*Attorney, Agent, or Firm*—Blair, Brown & Kreten

[57] ABSTRACT

Disclosed herein is a game device including a playing surface having games scoring indicia thereon by plural spaced regions each having point values, a sealed chamber underlying and coextensive with the playing surface containing plural magnets, in which the chamber is so fashioned that the magnets are constrained to remain oriented in one vertical alignment and are incapable of rotation. The magnets all have the same polarity proximate to the playing surface, and a further magnet is provided on the top playing surface which initially is oriented with its magnetic polarity similar to the magnets within the chamber in close tangential relation so that upon shaking the game device, the further magnet on the top face will be caused to flip over indicating that the magnets therebelow have been randomly redistributed. At least one die is then thrown to determine the number of markers to be cast. The markers are formed from spheres having polarities reactive to the magnet's polarity within the chamber to be cast. The quantity of these markers are determined by the dice roll, and these markers are then cast on the playing surface and are allowed to migrate under the influence of the magnets within the chamber. Indicia formed on the playing surface provides values for scorekeeping. The game device is housed in a container and storage areas are provided for the disposition and retrieval of the game markers.

11 Claims, 5 Drawing Figures

FIG 1
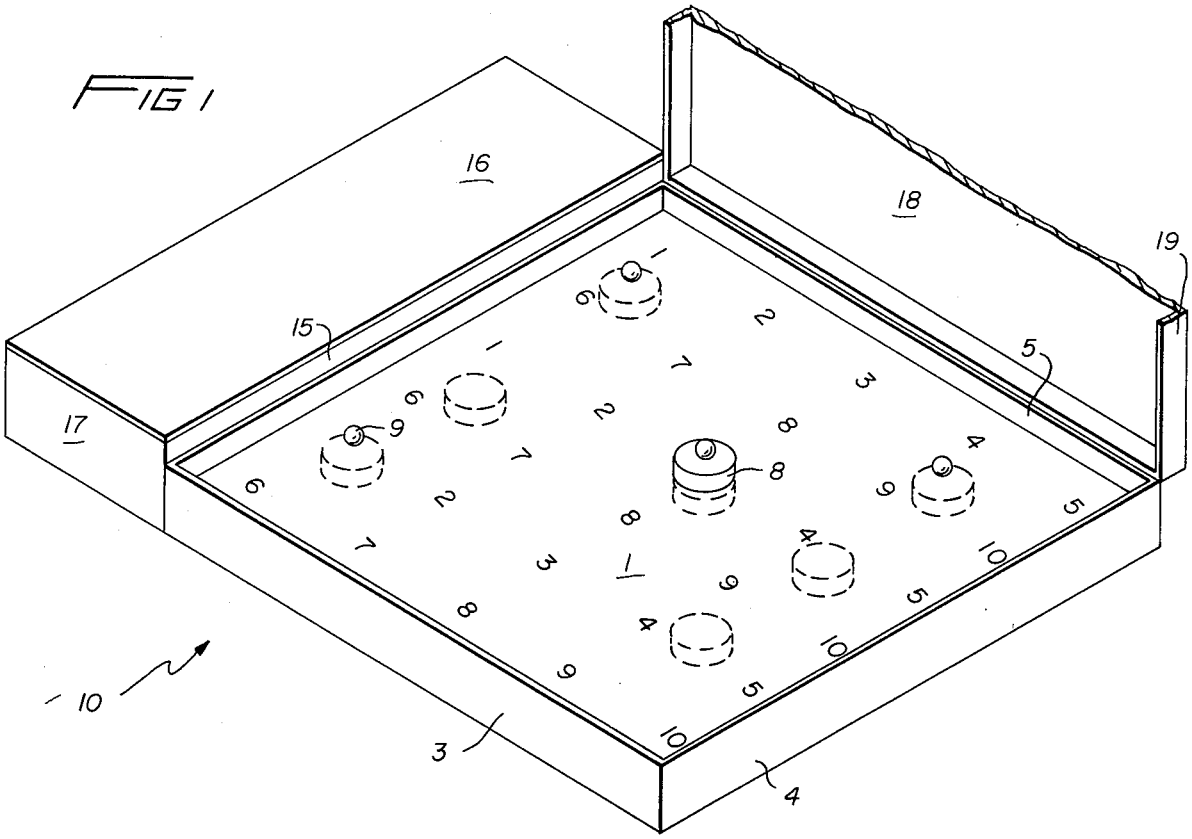
FIG 2
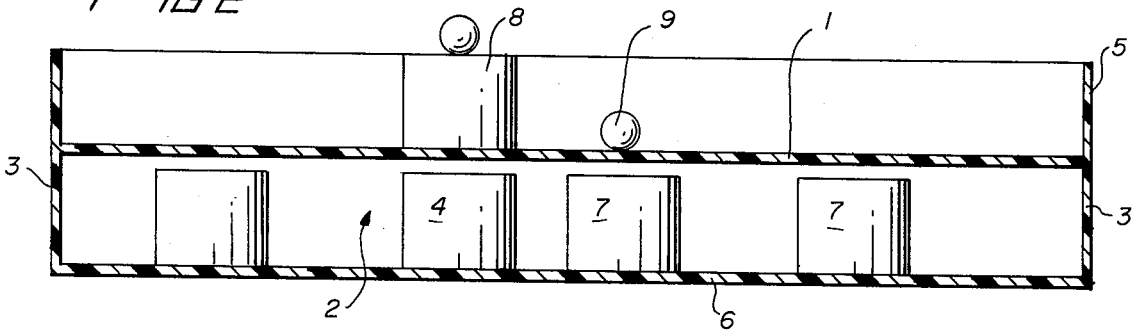
FIG 3
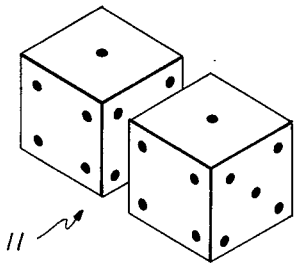
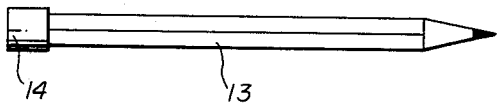
FIG 5
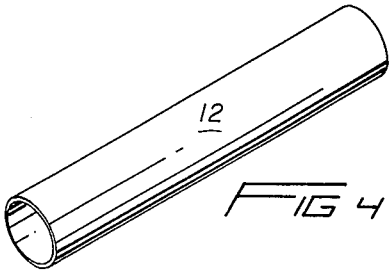
FIG 4

GAME DEVICE

BACKGROUND OF THE INVENTION

Civilization's fascination with games and amusement devices has probably existed for as long as civilization itself. Typically, a person's fascination with game devices and the like are enhanced when a game has been devised that is competitive in nature, relatively easy to understand, requires certain amounts of skill as well as chance, and can include curious physical properties commonly found in nature.

The following patents reflect the state of the art of which applicants are aware in so far as they are deemed pertinent to the patent process:

| | | | |
|---|---|---|---|
| 2,295,452 | Deaton | 2,819,904 | Nelson et al |
| 3,479,034 | Wagner | 4,034,980 | Sniderman |
| 4,049,275 | Skelton | 4,083,564 | Matsumoto |

Of these, Deaton appears to share some degree of similarity with the instant application in that he has provided a game board under which are disposed a plurality of magnets and on the playing surface of which is provided a map which allows the translation by manual manipulation of simulative vessels along the playing board by frictional translation whereby when a vessel encounters a hidden magnet, an indicator or flag upon the vessel is automatically deployed reflecting the outcome of the situation. In this device, the magnets disposed below the playing surface are bi-polar nearest the playing surface so that as a player moves the game piece into operative relation to one of the operating magnet's ends whereby the scoring depends upon which signal or flag is deployed. There is a tendency for all magnets to attract each other, thereby remaining in a cluster.

The remaining references teach the use of game boards and the like wherein magnets are provided which are not capable of random deployment within a sealed chamber so that their relative positions are not known.

By way of contrast, the device according to the instant application is directed to a game device which includes a playing surface having scoring indicia thereon defined by plural regions each having discreet point values, a sealed chamber underlying and coextensive with the playing surface containing magnetic means which are disposed within the chamber and constrained from rotation or disruption in so far as the polarity of a top face of each magnet therewithin in relationship to the playing surface. Further, an additional magnet is placed on top of the playing surface having a polarity identical to the top face of the magnets within the chamber and the game device is shaken to reorient the magnets within the seal chamber, this shaking being concluded when the magnet on top of the playing surface flips over indicating registry with an underlying magnet. A die or dice can then be deployed providing an indication of the total number of markers that can be cast upon the playing surface, the final disposition of these markers upon the playing surface being reflective of a player's score.

OBJECTS AND SUMMARY OF THE INVENTION

Accordingly, it is an object of this invention to provide a device which utilizes the player's penchant for a game that is competitive, requires skill and chance, includes a component exhibiting a naturally occuring phenomenon in nature for further fascination, and an overall game strategy.

It is a further object of this invention to provide a device of the character described above which has a relatively fast pace and while skill is an important consideration, players of unequal ability can be matched together for amusement.

It is a further object of this invention to provide a device of the character described above which is relatively inexpensive to manufacture, durable in construction, and extremely safe to use.

It is yet a further object of this invention to provide a device of the character described above in which situations including bonuses can occur so that the possibility of large point differentials in the scoring can be easily overcome.

These and other objects will be made manifest when considering the following application wherein a playing surface is provided having game scoring indicia thereon which overlies a coextensive sealed chamber having plural magnets therein all of which are oriented so that one magnetic polarity is proximate to the playing surface, the relationship between the playing surface and the chamber being such that the magnets contained within the chamber are incapable of reorientation from the polarity initialized therein, a further magnet deployed upon the top face of a playing surface which will flip over when in registry with an underlying magnet thereby providing an indication of a cessation of magnet deployment, at least one die to determine the number of markers that are to be subsequently cast upon the board which will migrate towards magnetic areas influenced by magnets within the chamber and by the further magnet on top of the playing surface, these markers migrating to regions having discreet point values or other directives thereon so as to provide a score or other indication.

These and other objects will be made manifest when considering the following detailed specification when taken in conjunction with the appended drawing figures.

BRIEF DESCRIPTION OF THE DRAWINGS

FIG. 1 is a perspective view of the game device according to the present invention.

FIG. 2 is a sectional view taken along lines 2—2 of FIG. 1.

FIG. 3 is a perspective view of two die which are conceivably to be utilized in the deployment of the markers in the game.

FIG. 4 is a perspective view of a marker retention cup used in casting the markers on the playing surface.

FIG. 5 is a side view of a score keeping pencil having a magnetic terminus to assist in the retrieval of the markers after they have been cast on the board and the scores have been computed.

BRIEF DESCRIPTION OF THE PREFERRED EMBODIMENT

Referring now to the drawings, wherein like reference numerals refer to like parts throughout the various drawing figures, reference numeral 10 is directed to the game device according to the present invention.

The game device 10 can generally be regarded as having a playing surface 1 which includes scoring indicia thereon defined by plural regions each having discreet values thereon. FIG. 2 shows an underlying sealed chamber 2 coextensive with the playing surface having a bottom wall 6, a shared top wall 1 which also serves as the playing surface, and two pairs of spaced opposed parallel sidewalls 3 and 4 respectively. Disposed within the chamber are a plurality of magnets 7 preferably of cylindrical configuration having upper and lower portions of diverse polarity, oriented in such a manner that all top portions of all magnets have the same polarity, the space between the top and bottom walls being such that the magnets are not allowed to fall onto their sides or be reoriented 180 degrees. Preferably, these magnets and a further magnet 8 disposed upon the top face of the playing surface are ceramic in composition having M1 parallel to the thickness thereof. In this manner, and given the orientation described hereinbefore, the magnets contained within the chamber will be mutually repulsive, and their uniformly random dispersal within the sealed chamber can be assured.

The playing surface is provided with a perimetral lip 5 extending around the playing surface 1, the lip 5 being of sufficient magnitude to confine marker means 9 on the playing surface. The marker means preferably take the form of relatively small spheres having a magnetic polarity or attractiveness opposite to the top portion of the magnets 7 confined within the chamber 2 so that upon being cast on the playing surface, these marker means 9 will migrate and be attracted to the plural magnets the location of which are unknown to the players casting the markers upon the playing surface. A storage compartment is provided which has one wall portion coincident with one of the side walls 4 of the chamber, and the storage means includes side walls 15, end walls 17 respectively in spaced parallel relationship, and top and bottom surfaces 16, the top surface of which is removeable to allow inclusion therein of the playing pieces when the game is not in use. Further, the device includes a cover 18 which is deployable over the playing surface, having side walls 19 of a dimension similar to the storage means so as to provide an overall device having substantially rectangular configuration, although other geometrical configurations are conceivable.

FIG. 3 shows conventional dice 11, FIG. 4 shows a container or cup 12 within which the markers 9 are originally placed for casting onto the playing surface, and FIG. 5 teaches the use of a pencil 13 having a magnetic tip 14 for the combined use of scorekeeping, and marker retrieval.

The method of playing the game will now be defined:

TO START THE GAME each player rolls both dice. Highest rolled dice scored goes first. Other players then go in turn from the first players left.

TO PLAY THE GAME

1. Place a silver/gold further magnet 8 on game board with the silver surface up assuring proper polarity orientation.

2. Close the game box and shake box until the magnet 8 flips to gold side up. This shaking will also shuffle the hidden magnets to new positions under the game board.

3. A player throws both dice to find out how many markers they can toss on the game board playing surface 1 during one turn. The dice are thrown only once at the beginning of a players turn.

4. A players turn is completed when the number of markers 9 tossed by them equals the value of their thrown dice.

5. A players turn consists of as many tosses as necessary to toss a quantity of markers equal to the value of the thrown dice.

6. A player, during their turn, has the option before each toss of changing the position of the silver/gold magnet 8 and the hidden magnets 7. This position change is done by repeating the first and second rules as stated above.

7. A player strategy is to have the magnet 8 flip over the stay on the highest possible game board numer. This magnet doubles the value of the number it stays on. When a silver marker e.g., lands on top of this magnet 8 then the player gets double score for that number. Metallic balls attracted to the side of the magnet 8 are scored normally.

8. When the magnet 8 flips over on more than one number the number doubled is that section covered by the largest part of the magnet 8.

9. When disc doubles are rolled a gold marker may be included as part of the total ball tosses within a players turn. This gold marker doubles the value of the number it lands on. When the gold metallic ball is attracted to the top of the doubling magnet the board value is multiplied by four.

SCORING THE GAME

A players score consists of the sum of the tosses during each turn. The score from one toss equals the sum of the game board values that have attracted the metallic balls. The first player to reach a score equal or better than the game value wins and ends the game.

As is evident from the foregoing, the markers may have plural different colors, and the further magnet contained and deployed on the top surface of the playing board is colored coded for ease in use. Further, it should be apparent that the indicia displayed on the playing surface may have different surface designs and therefore the rules may change also so that all Casino games, all sports game, darts and ESP games, etc., are capable of being included as a portion of the game.

In view of the foregoing, it should be apparent that there has been provided a game device including a playing surface having scoring indicia thereon defined by plural regions each having discreet point values or other directives, a sealed chamber underlying and coextensive with the playing surface, a game apparatus storage area proximate to the playing surface and contiguous with one side wall of the chamber, plural magnetic means disposed within the chamber randomly deployable therein and constrained so that a single polarity is always proximate to the top or playing surface area, and plural marker means conceivably of different colors having a corresponding different value capable of being deployed thereupon.

Further, it should be apparent that numerous structural modifications are contemplated as being a part of this invention as set forth hereinabove and as defined hereinbelow by the claims.

What is claimed is:

1. A game device comprising in combination:

a playing surface having game scoring indicia thereon defined by plural regions each having discreet values thereon, a sealed chamber underlying and coextensive with said playing surface, first magnetic means disposed within said chamber randomly deployed and having a single polarity proximate to said playing surface, and marker means magnetized of a polarity opposite to said first magnetic means proximate to said playing surface castable on said playing surface whereby when so cast, said marker means migrates towards said first magnetic means and on said regions thereby providing an indication.

2. The device of claim 1 further including a perimetral lip extending upwardly around said playing surface to confine said marker means to said playing surface.

3. The device of claim 2 further including a second magnetic means disposed on said playing surface having upper and lower portions of diverse polarity.

4. The device of claim 3 wherein said sealed chamber has at least one side wall common to and coextensive with a storage means having a removeable top surface.

5. The device of claim 4 wherein said playing surface has an overlying removeable lid.

6. The device of claim 5 wherein said marker means are cast on said playing surface from a retaining cup, and said game includes dice for marker means quantity selection.

7. The device of claim 6 wherein said first and second magnetic means are cylindrically formed with end surfaces of opposite polarity.

8. The device of claim 7 wherein said marker means are magnetically attractable spheres having plural colors.

9. The device of claim 8 wherein the height of said chamber is slightly greater than said first magnetic means to constrain first magnetic means from tipping over.

10. A method for playing a game having a playing surface, and underlying chamber with plural magnets therein, the steps including:

shaking the chamber to reorient the magnets, casting markers on the playing surface and computing a value reflective of the marker's relative disposition on the playing surface.

11. The method of claim 10 including the steps of placing a further magnet on the playing surface with a polarity on its bottom face the same as on the top face of the magnets within the chamber and shaking the game until the further magnet flips 180 degrees prior to casting, and rolling dice to determine the number of markers to be cast prior to casting.

* * * * *